US005368253A

United States Patent [19]

Hartley, Jr.

[11] Patent Number: 5,368,253

[45] Date of Patent: Nov. 29, 1994

[54] CONTINUOUS REWIND WITH NO-FOLD-BACK SPLICER

[75] Inventor: John J. Hartley, Jr., Pewaukee, Wis.

[73] Assignee: Faustel Incorporated, Germantown, Wis.

[21] Appl. No.: 54,052

[22] Filed: Apr. 23, 1993

[51] Int. Cl.[5] ..... B65H 19/28; B65H 21/00

[52] U.S. Cl. ..... 242/527.4; 242/532.3

[58] Field of Search ..... 242/56.8, 56 R, 56 A, 242/526.1, 527.3, 527.4, 532.3

[56] References Cited

U.S. PATENT DOCUMENTS

| | | | |
|---|---|---|---|
| 1,518,428 | 12/1924 | Hudson | 242/56 A |
| 3,529,785 | 9/1968 | Mistele | 242/56 R |
| 3,823,887 | 7/1974 | Gerstein | 242/56.8 X |
| 4,422,586 | 12/1983 | Tetro | 242/56 R |
| 4,530,265 | 7/1985 | Lee et al. | 83/337 |
| 4,948,061 | 8/1990 | Krimsky et al. | 242/58.3 |

FOREIGN PATENT DOCUMENTS

| | | | |
|---|---|---|---|
| 2105688 | 3/1983 | United Kingdom | 242/56.8 |

OTHER PUBLICATIONS

Drawings of I.M.D. Corp. vacuum transfer splicer Sheet 1: Operator side view; Sheet 2: Front view A—A from sheet No. 1.

*Primary Examiner*—Daniel P. Stodola
*Assistant Examiner*—John Q. Nguyen
*Attorney, Agent, or Firm*—Nilles & Nilles

[57] ABSTRACT

A splicing mechanism on a continuous rewind apparatus cuts and transfers a moving web onto a new core with a no-fold-back and wrinkle-free splice. The splicing mechanism includes a perforated cutting knife provided with a set of gaps spaced apart along the length of the knife. Cutting the web with the perforated knife results in a partially cut web wherein small tabs of material hold the tail and the new leading edge of the web together. The tabs precisely control the new leading edge of the web until it reaches the new core. The web is then pressed against the new core which is covered with an adhesive tape. However, the adhesive is unable to hold the tail portion of the web, which is still intact, and the tail is therefore pulled away from the new core and rewound onto the finished roll. When the cut section of the web reaches the new core, the adhesive bond between the web and the new core is stronger than the tabs, so the tabs break, allowing the tail to continue on its way while the leading edge is smoothly and flatly affixed to the new core. No-fold-backs or wrinkles result from the splice. A mechanism for resetting the knife is also provided on the rewind apparatus.

6 Claims, 6 Drawing Sheets

CONTINUOUS REWIND WITH NO-FOLD-BACK SPLICER

BACKGROUND OF THE INVENTION

1. Field of the Invention

This invention relates to a splicing mechanism on a roll changing apparatus for cutting and transferring a moving web to a new core without stopping movement of the web. In particular, this invention relates to a method and apparatus for splicing the moving web without causing a fold-back or wrinkling of the web on the new core.

2. Background of the Related Technology

Many commercial and industrial laminating, coating and film processing operations are conducted on high speed web handling equipment which operate continuously for long periods of time. Paper converting is one example of such an operation. At the end of the processing line the web is wound lengthwise into a large parent roll or mill roll of material. In the processing of web materials, it is inefficient to stop the entire operation each time an individual roll of material needs to be changed. For this reason, rewinding devices have been developed for cutting and transferring a moving web so that successive rolls of material may be continuously wound without interrupting the operation.

One such rewind device, commonly referred to as either a turnover rewind stand or turret rewinder, is disclosed in U.S. Pat. No. 3,529,785 assigned to the same assignee as the present invention. A turnover rewind stand includes a pair of rotatable spindles or spools to which the web may be affixed for rewinding purposes. The two spindles are mounted on a turret, and by revolving or "turning over" the turret, the spindle containing a fully wound roll of web material is moved out of the rewinding position and a new core is simultaneously moved into the rewinding position. Upon severing the web, the new leading edge of the web is affixed to the empty core to continue the rewinding of the web while the finished roll is removed from the rewind stand. This process may be repeated over and over in order to rewind a number of rolls successively for as long as the web processing line is operated.

The transfer of the web to a new core is typically accomplished by pressing or pasting the web against a new core which has been covered with a tacky adhesive, although other methods of affixing the web to the core exist. After the web is put in contact with the core, the web is severed with a knife at a point downline from the new core. The web is thereby rewound onto the new spindle.

Since this type of splicer involves cutting the web at a point after the web has passed the new core, this type of mechanism often causes the web to fold-back on itself on the new core when the splice is performed. This fold-back results in a double thickness of the web and wrinkling of the web at the core which is undesirable. While the affects of the fold-back may be alleviated after a number of revolutions on the new spindle, nonetheless the fold-back results in a significant amount of wasted material. It is therefore desirable to provide a web splicing device which will not produce a fold-back and instead the web material transferred to the new core should be fold and wrinkle-free from the very start.

Other devices have been developed in an effort to provide a "no-fold-back" transfer of a moving web, but such devices are very complex and expensive and their effectiveness is less than certain, especially on high speed operations. For example, U.S. Pat. No. 4,422,586 to Richard S. Tetro (The Black Clawson Company) discloses a device which causes the web to deflect into a knife in order to sever it and transfer it to a new roll. On the Tetro device, an adhesive strip is applied to the outer surface of a new core upon which the web is to be wound. A cutting blade is brought into close proximity to the new core. The web is then urged toward the new core so that the adhesive strip bonds to the surface of the web and furthermore causes the web to deflect slightly into the blade so that the web is severed at a point immediately adjacent to the adhesive strip. The leading edge of the severed web remains adhered to the adhesive strip so that the web may be wound onto a new core.

Despite the assertion in the Tetro patent that the device disclosed therein provides a no-fold-back transfer of the web, the fact of the matter is that the splice is made after the web passes the new core and that on at least some applications a fold-back does occur even though it may be a small one. More importantly, the device disclosed in the Tetro patent is limited in its application to relatively thin web materials. In operations involving thicker grades of material, it is difficult to create a sufficient deflection in order to sever the web utilizing the approach disclosed in the Tetro patent.

Another no-fold-back device available in the market is produced by IMD Corporation. The IMD device passes the web between two rotating rolls which contain a complex set of splicing and vacuum mechanisms for cutting and transferring the web onto a new core. Within one roll is a knife which is extendable outward from the surface of the roll. The second roll is provided with a cavity which the knife projects into. The second roll also has a vacuum chamber which includes a grid having a number of small holes on the outer surface of the roll immediately adjacent the cavity. The small holes in the grid are used to apply a vacuum to hold the web against the outer surface of the second roll. The rotation of the first and second rolls are timed so that the knife from the first roll projects into the cavity of the second roll to sever the web. The application of the vacuum is also timed so that it will hold the leading edge of the severed web against the second roll, then the vacuum is released so that the leading edge may be transferred to a third roll, i.e. the new core.

The timing of the cutting action of the knife is critical in order to sever the web, and the timing of the application and release of the vacuum is also critical in order to transfer the web to the new core. Both timing aspects are extremely difficult to achieve in high speed operations. Some web processing lines operate at over 1000 feet per minute. It is nearly impossible to extend and then retract the knife, and to apply and then release the vacuum, at the critical times and to do so quickly enough to attain high speeds. The use of a thick grade of web material causes further difficulties in using the IMD splicing process.

SUMMARY OF THE INVENTION

A splicing mechanism on a continuous rewind apparatus for cutting and transferring a moving web onto a new core with a no-fold-back and wrinkle-free splice is disclosed. The no-fold-back splicing mechanism includes a special perforated cutting blade which cuts the web before the web reaches the new core. The cut, however, is not complete. A set of spaced apart gaps in the cutting blade result in a partially cut web wherein small tabs are left across the cut section of the web. The small tabs hold the new "leading edge" of the web to the "tail" of the finished roll.

The invention further includes a cushioned roll which has the dual function of pressing the web into contact with the new core and cooperatively engaging the knife in order to cut the web. The new core is covered with an adhesive. Even though the tail may briefly contact the adhesive on the new core, the internal strength of the web material is stronger than the adhesive, so the tail simply passes over the new core. The tail therefore continues on its usual route to the finished roll. However, when the tab connected cut section of the web reaches the new core, the adhesive forces overpower the strength of the tabs and rips them apart. The tail is free to be wound up on the finished roll, while the leading edge of the severed web becomes affixed to the new core. Because the final, complete severance of the web (i.e. the tearing of the tabs) does not occur until the leading edge is pasted against the new core where it can be completely controlled, no-fold-back or wrinkles occur on the initial windings of the new core.

The primary objects of the invention are therefore to provide an apparatus and method for changing rolls on a continuous rewind operation which produces a no-fold-back and wrinkle-free splice; to cut the web at a point before it reaches the new core and to control the web as it is introduced onto the new core; to control the web by only partially severing it, leaving a set of tabs to hold the tail of the finished roll and the new leading edge of the web together; to provide a means for applying an adhesive bond between the web and the new core; to provide a means for breaking the tabs such that the tail of the web is wound about the finished roll and the new leading edge is smoothly and flatly applied to the new core; to provide a means for retracting and resetting the knife for another splicing operation; and to provide a no-fold-back, wrinkle-free splicing mechanism which is adaptable for use in splicing a wide range of web materials on either high-speed or low-speed rewind operations.

Other objects and advantages of the invention will become apparent from the following description which sets forth, by way of illustration and example, certain preferred embodiments of the invention.

BRIEF DESCRIPTION OF THE DRAWINGS

The drawings, which constitute a part of the specification and include exemplary embodiments of the present invention, include the following.

DETAILED DESCRIPTION OF THE PREFERRED EMBODIMENTS

Figure 1:
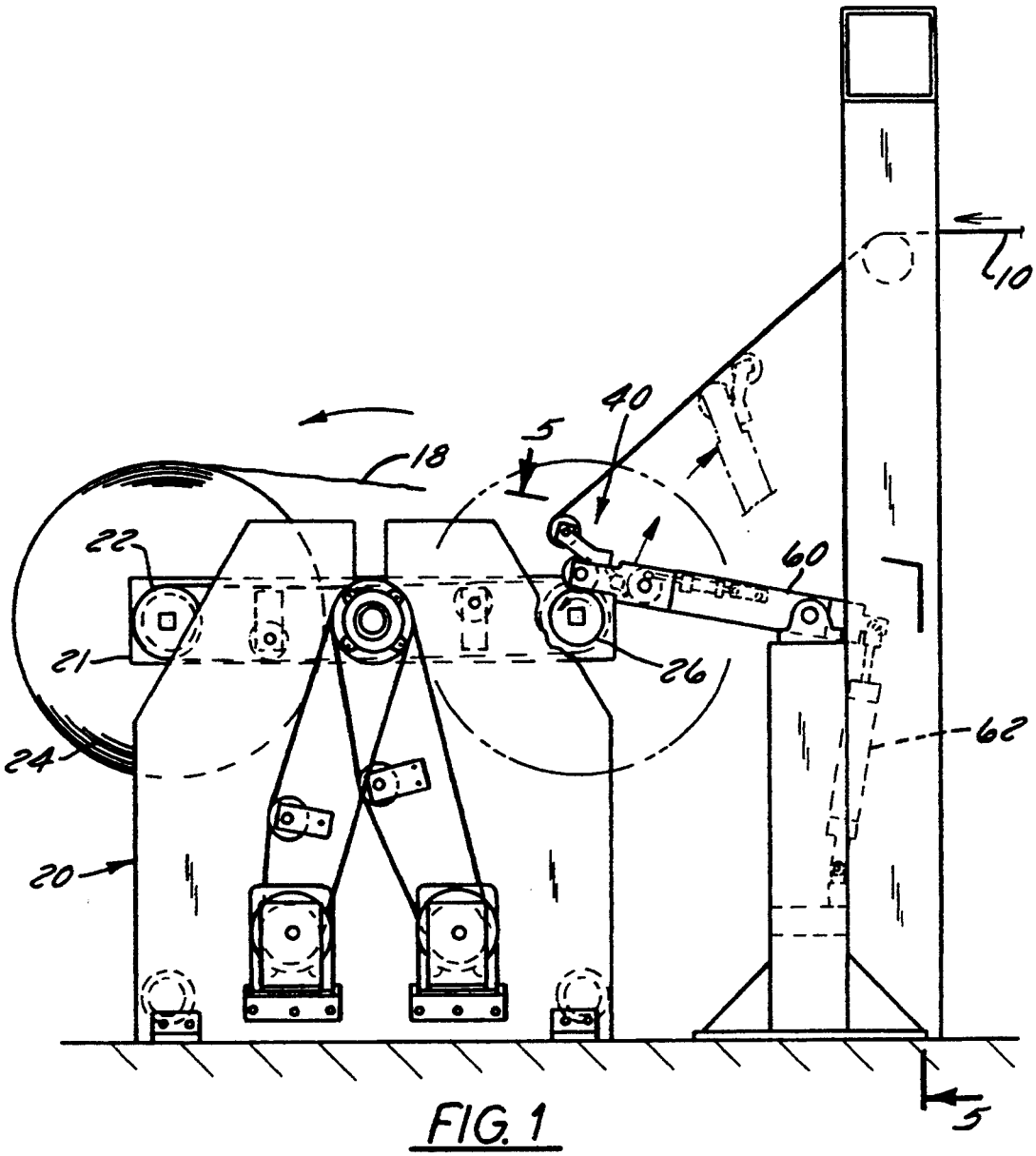
FIG. 1 is a side view of a no-fold-back splicing mechanism constructed in accordance with the principles of the invention. The splicing mechanism is shown in an overmode configuration, that is, the splicing mechanism is retractable from above the new core on the rewinder.
Figure 8:
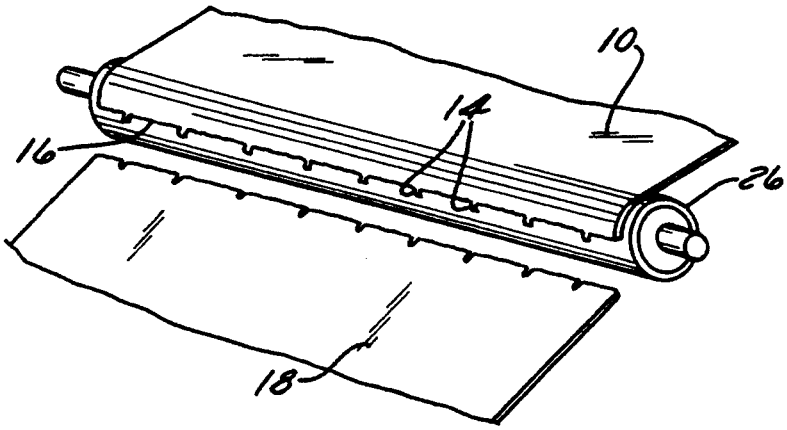
FIG. 8 is a perspective view showing how the tabs of the partially cut web are broken so that the tail of the severed web is wound on the finished roll and the new leading edge becomes affixed and wound onto the new core.
Figure 2:
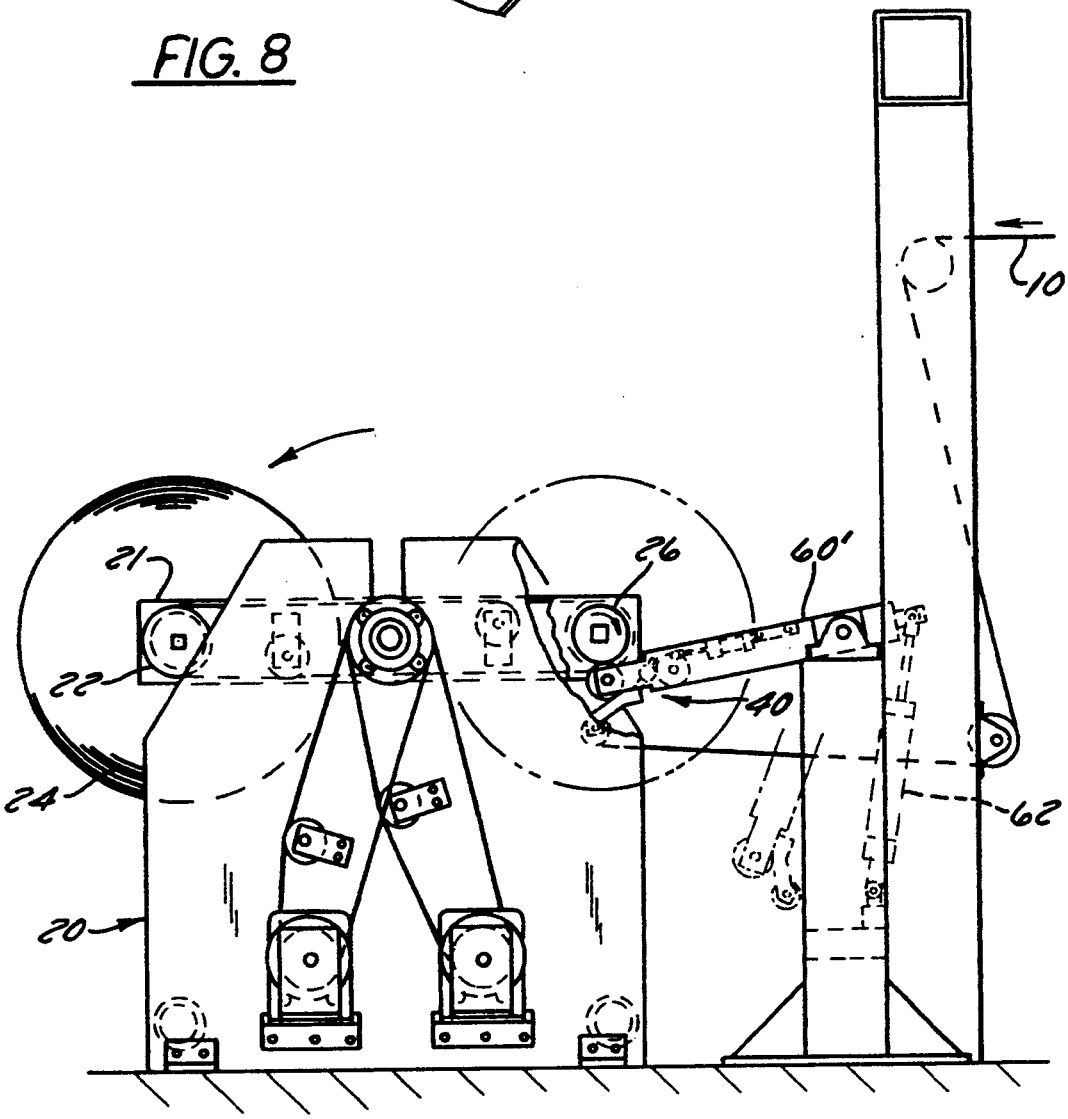
FIG. 2 is a side view of a second embodiment of the invention in which the splicing mechanism is adapted in an undermode configuration so that it is retractable from below the new core of the rewind roll.
Figure 3:
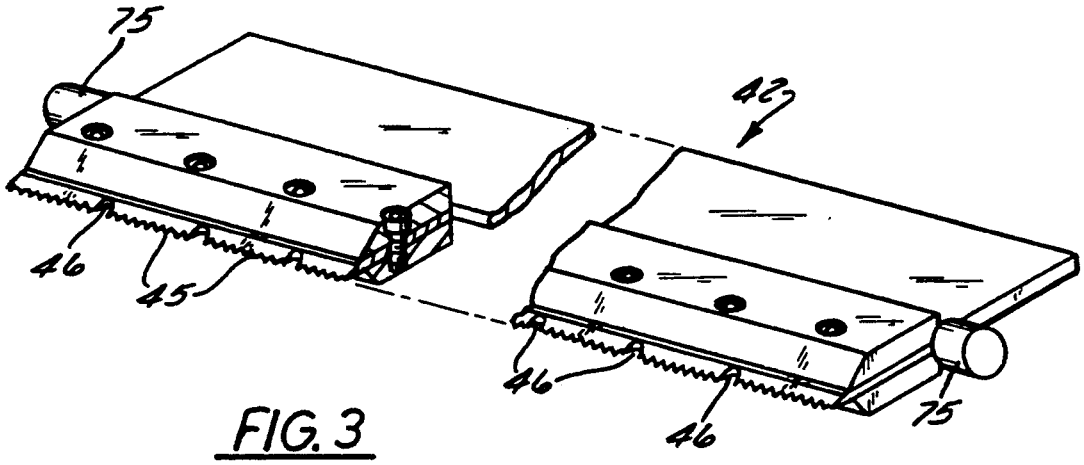
FIG. 3 is a perspective view of the cutting blade.
Figure 4:
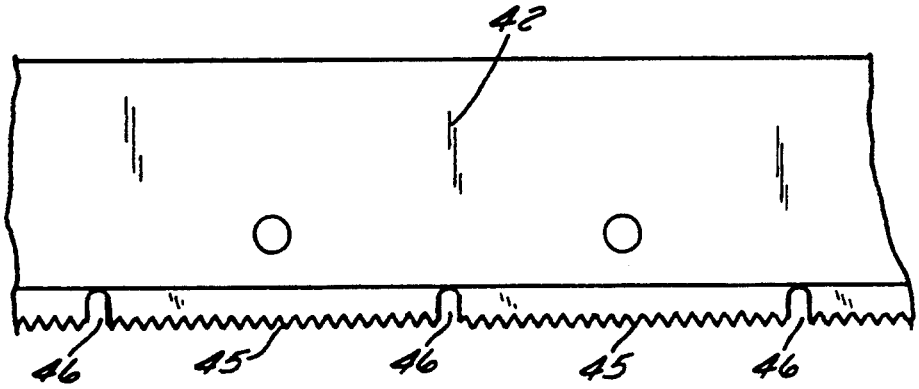
FIG. 4 is a detailed view of the blade showing the spaced apart gaps or reliefs which form the tab connections between the tail and leading edge when the web is cut.

The primary components of the present invention include a rewind stand 20 and a splicing mechanism 40. The rewind stand 20 is used to rewind a web 10 of paper, plastic or other film material which has been processed on coating, printing laminating, converting or other web handling equipment. The web 10 is rewound into large rolls, sometimes called parent rolls or mill rolls or finished rolls 24 for further processing or shipment to the customer. The rewind stand 20 should be a type capable of rewinding successively a number of rolls of material. The splicing mechanism 40 is used to splice the continuously moving web 10 and affix it to a new core 26.

As mentioned above, rewind stand 20 includes a pair of rotatable spindles or spools on each end of a turret arm 21 for rewinding the web. FIG. 1 shows a first core 22 which has a substantial amount of web material 24 wound around it. The first core 22 is situated on one end of the turret arm 21, and a second core 26 is situated on the opposite end of the turret arm 21. The rewinding operation is normally conducted in the position closest to the end of the processing line. By rotating the turret arm 21, the first core 22, which is ready to be finished and removed from the rewind stand, has been positioned away from the web processing line and the second core, i.e. the new core 26, has been simultaneously rotated into position to take over the rewinding operation. Once the splicing operation is completed, the finished roll 24 may be removed from the rewind stand 20 while the web material 10 continues to be rewound on the new core 26. When a sufficient amount of material has been rewound onto the new core, the turret is again rotated so that the web material may be rewound on another new core, and so on.

The splicing mechanism 40 is mounted on a pair of swing arms 60 on each side of the web 10 which swing the splicing mechanism 40 from above down toward the new core 26 under the action of a cylinder 62 so as to permit selective retraction of the splicing mechanism 40 for. A small gap is left between the web 10 and the new core 26 until just prior to making the splice. The splicing mechanism 40 severs the web 10 so that the tail 18 of the severed web 10 can continue on its way to be rewound onto the finished roll 24, while the new leading edge 16 of the web 10 may be affixed onto the new core 26 to continue the rewinding operation.

The splicing mechanism 40 includes a knife 42 which extends across the width of the web 10 at a location upstream from the new core 26. The knife 42 has a perforated edge. More specifically, the length of the knife 42 consists of a series of relatively long sections 45 with sharp, pointed cutting edges. The long cutting sections 45 are separated by a set of narrow reliefs 46 or gaps located at spaced apart intervals along the length of the knife 42. When the knife 42 is passed into the line of travel of the web 10, the gaps 46 in the knife 42 result in only partially severing the web 10 material. The sharp edge sections 45 of the knife 42 cut completely through the material while the gaps 46 in the knife 42 leave behind tabs 14 of uncut material which hold the web 10 together.

The knife 42 is preferably mounted on a rotatable knife holder in the form of a mounting bar 75 positioned across the width of the web 10. On the opposite side of the web 10 is a roll 54 which acts like an anvil or cutting block in cooperation with the knife 42 in order to cut the web 10. The outer surface of the roll 54 is covered with a cushion 56 of rubber or similar material. The web 10 is passed over the cushioned roll 54 and the knife 42 is rotatably engageable into the cushioned roll 54. The edge of the knife 42 rotates at approximately the same arc speed as the outer surface of the cushioned roll 54, which also is the same linear speed as the web material 10. Upon initiating the cutting action of the knife 42, the knife 42 may be allowed to freely rotate in a manner such that as the knife 42 initially engages into the web material 10 and then digs into the cushion 56, the knife 42 is carried through the cutting arc at the same speed as the web 10 and cushioned roll 54 are moving. This provides for a straight clean cut of the web material.

At about the same time that the cut is made, or just prior to it, the web 10 is pressed against the new core 26. The new core 26 consists of a long cardboard tube commonly used to rewind web material and it has an adhesive coating applied around its outer circumference, e.g. two-sided adhesive tape. The new core 26 initially engages a portion of the web 10 which is before the cut section or seam, i.e., the portion that will become the tail 18 of the finished roll 24. However, since the tail portion 18 is still intact across its entire width, that is, it is uncut, the internal strength of the tail 18 is stronger and thus overcomes the adhesive bond between the new core 26 and the surface of the web. The tail 18 is consequently pulled past the new core 26 and continues on its normal course to be rewound onto the finished roll 24.

As the cut section or seam of the web 10 continues on its path toward the new core 26, the tabs 14 hold the tail 18 and the new leading edge 16 together. The number and width of the tabs 14 necessary to hold the web together will depend on the type and basis weight of the web material being processed. When the cut section or seam reaches the new core 26, the adhesive bond between the new core 26 and the web material overpowers the tabs 14. Therefore, the tabs 14 are broken and the leading edge 16 of the web material remains glued to the new core 26, while the tail 18 proceeds upon its normal path to be wound around the finished roll 24. Since the leading edge 16 has been held by the tabs 14 in the precise line of travel of the web 10, the new leading edge 16 is smoothly affixed to the new core 26. No fold-back or wrinkles result from the splicing operation.

Once the knife 42 has made its cut into the web 10, the knife 42 may not be returned to its original pre-cut position by merely rotating back along the same arc of travel—it would cut into the web again. The splicing mechanism 40 must therefore include a means for retracting the knife 42 and resetting it to its original position. The embodiment of the invention described here utilizes an eccentric to retract the knife 42, although a number of other retracting means may work equally as well.

Figure 5:
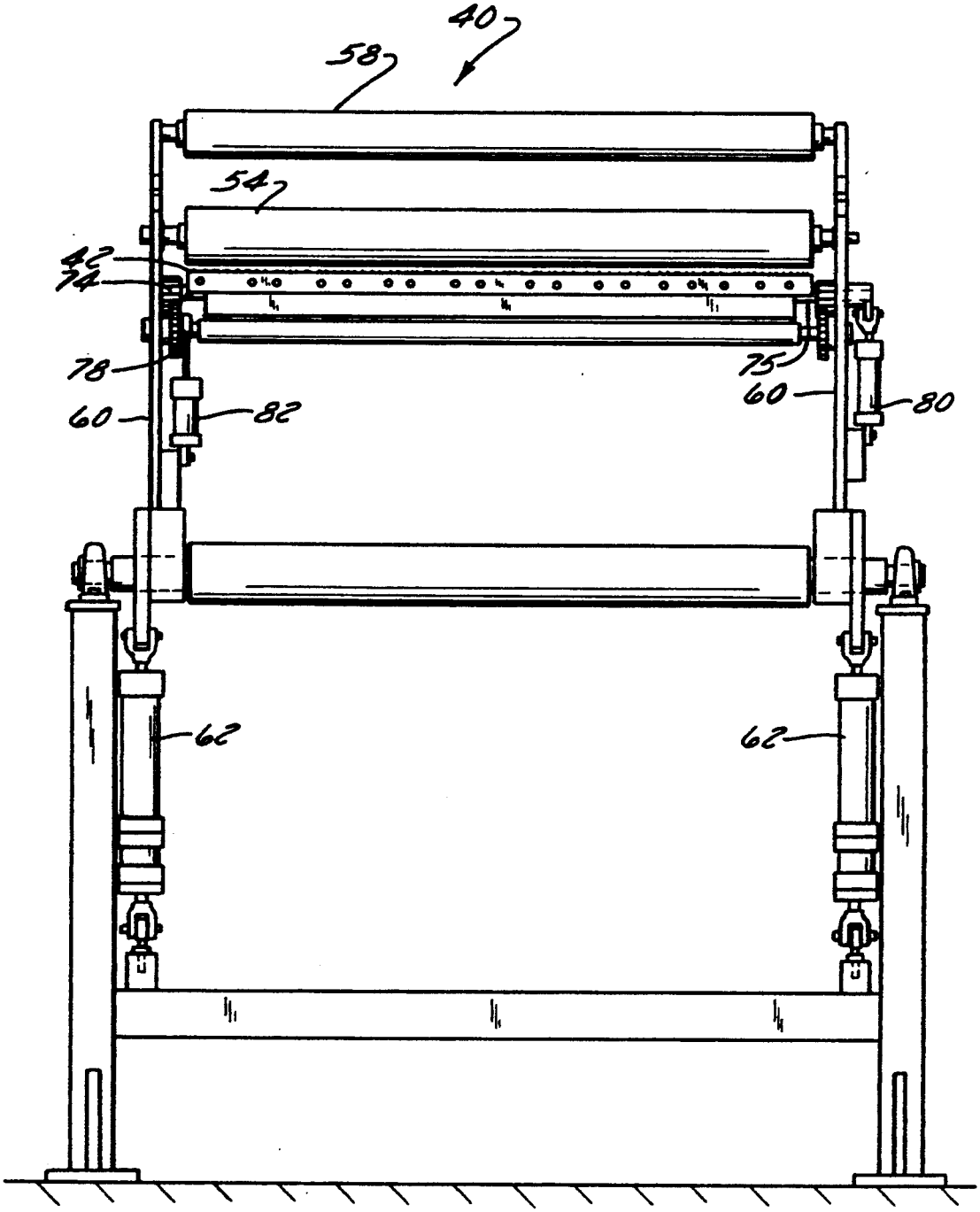
FIG. 5 is a plan view of the splicing mechanism of the present invention, shown along line 5—5 of FIG. 1.
Figure 6:
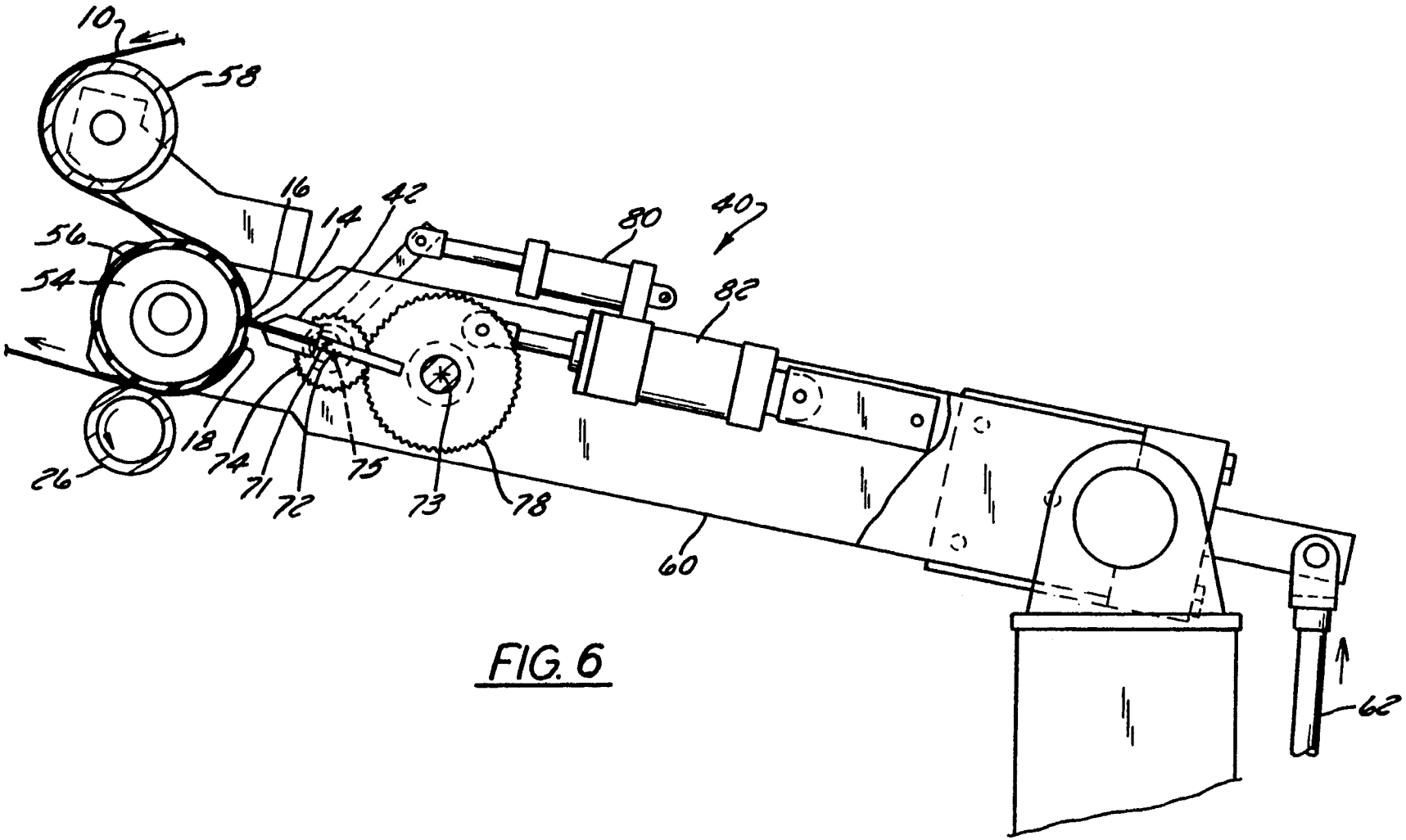
FIG. 6 is a detailed view of the splicing mechanism partially in section. The knife is shown making a cut into the web.
Figure 7:
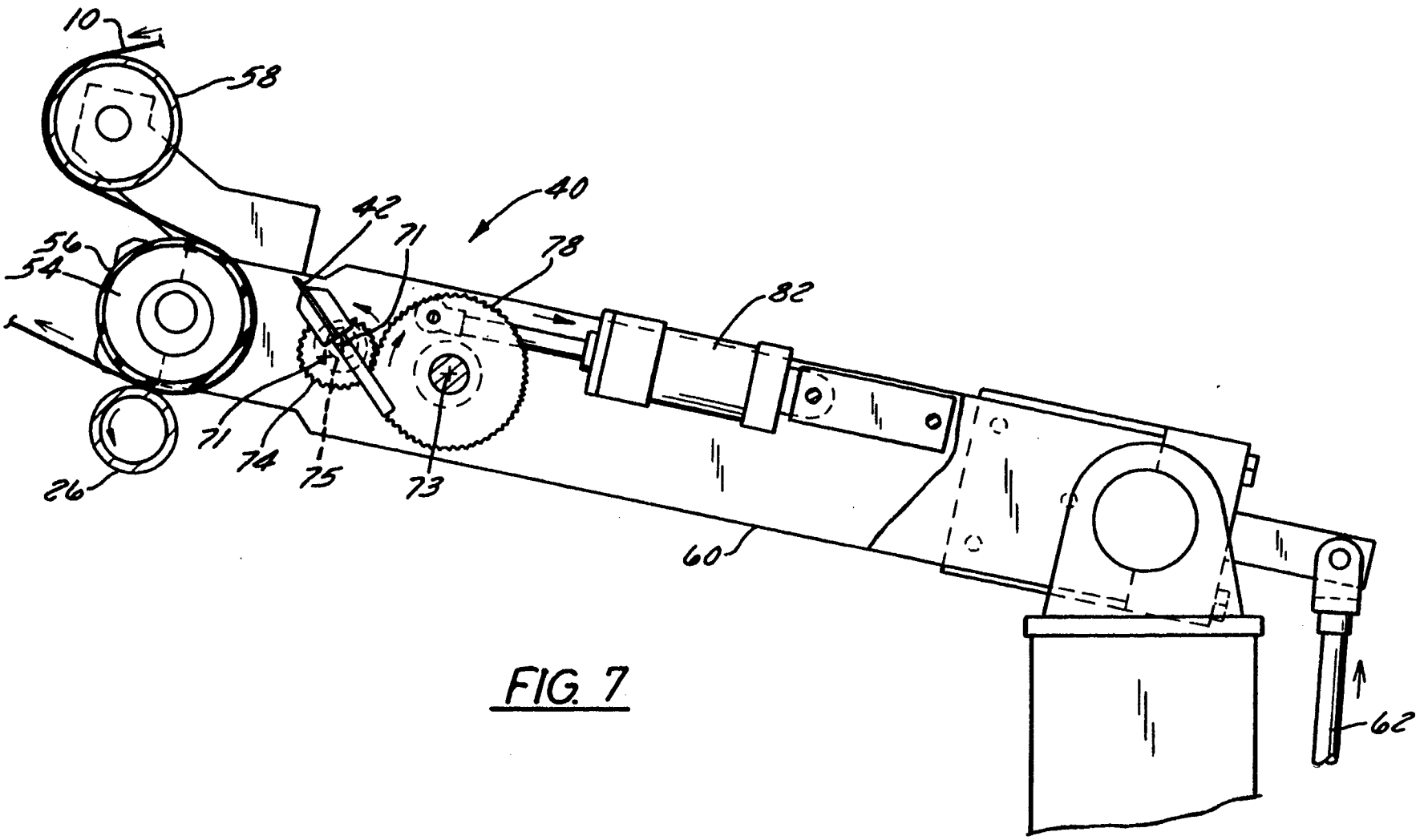
FIG. 7 is also a detailed view of the splicing mechanism, further showing the operation of an eccentric for retracting and resetting the knife for a further splice.

Details of the eccentric employed in the present invention, shown in FIGS. 5, 6 and 7, include a knife holder in the form of a pivotable mounting bar 75 for the knife 42, a knife holder support for circular member in the form of a first gear 74, a second gear 78, a first pneumatic cylinder 80 for actuating the knife 42, and a second pneumatic cylinder 82 for actuating the eccentric. The web 10 is traveling past an idler roll 58, the cushioned roll 54 and the new core 26.

The knife mounting bar 75 is pivotable about a first axis 71. The first gear 74 is pivotable about a second axis 72 at its center. The knife mounting bar 75 is mounted on the first gear 74 and the first gear 74 is mounted on the swing arm 60, such that rotation of the first gear 74 results in rotation of the first axis 71 about the second axis 72. The second gear 78, also mounted on the swing arm 60, is likewise pivotable about third axis 73 at its center. The second gear 78 intermeshes with the first gear 74 at about a 2:1 ratio.

The knife 42 is initially in a retracted position such that the first axis 71 of the mounting bar 75 is positioned away from the cushioned roll 54. As the second pneumatic cylinder 82 for the eccentric is retracted, the second gear 78 rotates in a clockwise direction (looking at FIG. 7), which in turn rotates the first gear 74 counterclockwise, thereby rotating of the first axis 71 of the knife mounting bar 75 closer to the cushioned roll 54. The knife 42 is now located in a cutting position. The web 10 is then brought into contact with the new core 26, and immediately thereafter the knife activation cylinder 80 is actuated, thereby rotating the knife 42 counterclockwise (looking at FIG. 6) downward through the web 10. The cut section of the web 10 then continues on and the new leading edge 16 is affixed to the new core 26 in the manner described above.

In order to retract and reposition the knife 42 the eccentric cylinder 82 is extended to rotate the second gear 78 counterclockwise (looking at FIG. 7), which in turn rotates the first gear 74 clockwise, thereby rotating the first axis of the knife mounting bar 75 away from the cushioned roll 54. The knife activation cylinder 80 then retracts to rotate the knife 42 back to the pre-cut position where it started. The splicing mechanism 40 is now ready to make another splice.

Finally, it is recognized that the present invention may be constructed in a number of configurations all of which satisfy the primary objective of providing a no-fold-back, wrinkle-free splice for changing rolls on a continuous rewinder. For example, the splicing mechanism may be reconfigured onto a pair of arms which swing from below the new core, or mounted on a slide in conjunction with a surface drive roll which slides the splicing mechanism toward and away from the new core. The knife may also be reconfigured to project in a linear direction to cut the web. Furthermore, alternative means for retracting the knife may be used other than an eccentric.

Therefore, specific details of the invention disclosed above are not to be interpreted as limiting, but merely as a basis for the claims and for teaching one skilled in the art to variously practice and construct the present invention in any appropriately detailed matter. Changes may be made in details of construction of the invention without departing from the spirit of the invention, especially as defined in the following claims.

I claim as my invention:

1. A method of splicing a moving web to a new core to rewind the web comprising:

winding the moving web onto an old core of a rewinder, the new core being positioned upstream of the old core; and splicing the moving web onto the new core, the splicing step including partially severing the moving web across its width at a location upstream of the new core, thereby producing a tail portion and a new leading edge joined to one another at a seam; then passing the moving web in contact with and across the new core to a position in which the seam of the moving web is positioned on the new core; then pulling apart the moving web at the seam as the moving web is passing across the new core and when the seam is positioned on the new core, thereby leaving the new leading edge of the moving web on the new core; and bonding the new leading edge of the moving web to the new core when the moving web is pulled apart.

2. The method according to claim 1, wherein the moving web is partially severed by cutting the moving web with a series of relatively long cuts which extend completely through the moving web and leaving a set of uncut tabs in between the long cuts which hold the moving web together at the seam.

3. The method according to claim 2, further comprising applying adhesive to the new core; and wherein the bonding step includes pressing the moving web against the adhesive on the new core and the pulling step includes pulling the tail portion of the moving web in order to break apart the tabs to produce the new leading edge of the moving web; and further comprising winding the tail portion of the moving web around a finished roll; and winding the new leading edge of the moving web around the new core.

4. The method according to claim 1, further comprising passing the moving web across a cushioned anvil roll, and wherein the step of partially severing the moving web includes rotating a complementary knife having a set of reliefs such that the knife cooperates with the cushioned anvil roll to partially cut the moving web.

5. The method according to claim 4, wherein the step of partially severing further comprises activating the knife to partially cut the moving web, and wherein the splicing step further comprises retracting the knife away from the cushioned anvil roll and repositioning the knife for another splicing operation.

6. The method according to claim 4, further comprising moving the knife and cushioned anvil roll in close proximity to the new core prior to the splicing step and moving the knife and cushioned anvil roll away from the new core after the splicing step.

* * * * *